US005937362A

United States Patent [19]

Lindsay et al.

[11] Patent Number: 5,937,362

[45] Date of Patent: Aug. 10, 1999

[54] METHOD FOR PREDICTING PORE PRESSURE IN A 3-D VOLUME

[75] Inventors: Richard Owens Lindsay, Tulsa; David Alan Ford, Broken Arrow, both of Okla.

[73] Assignee: Diamond Geoscience Research Corporation, Houston, Tex.

[21] Appl. No.: 09/018,265

[22] Filed: Feb. 4, 1998

[51] Int. Cl.[6] ..... G06F 19/00

[52] U.S. Cl. ..... 702/9

[58] Field of Search ..... 702/9, 11, 12, 702/13, 6; 73/152.05, 152.06, 152.07; 166/250.07; 175/48; 367/72

[56] References Cited

U.S. PATENT DOCUMENTS

| | | | |
|---|---|---|---|
| 4,981,037 | 1/1991 | Holbrook et al. | 73/152.05 |
| 5,128,866 | 7/1992 | Weakley | 364/421 |
| 5,343,440 | 8/1994 | Kan et al. | 367/27 |

OTHER PUBLICATIONS

Debra Maucione, et al., University of Wyoming, Laramie, Wyoming, U.S.A., A Sonic Log Study of Abnormally Pressured Zones in the Powder River Basin of Wyoming, p. 333–348, No Date Given.

E. S. Pennebaker, The Use of Geophysics In Abnormal Pressure Applications, Apr. 1969.

Edward B. Reynolds, et al., The Geophysical Aspects of Abnormal Fluid Pressures, p. 31–47, No Date Given.

Norman E. Smith, et al., The Origins of Abnormal Fluid Pressures, p. 4–19, No Date Given.

*Primary Examiner*—Donald E. McElheny, Jr.

*Attorney, Agent, or Firm*—Tim Headley; Haynes and Boone, L.L.P.

[57] ABSTRACT

A pore pressure prediction method includes the steps of: (a) designing a normal compaction trend velocity model; (b) testing the normal compaction trend velocity model; (c) designing 3-D spatial adjustment parameters to compensate for water depth; and (d) processing a 3-D velocity field using the interpreted normal compaction trend velocity model and the 3-D spatial adjustment parameters.

6 Claims, 8 Drawing Sheets

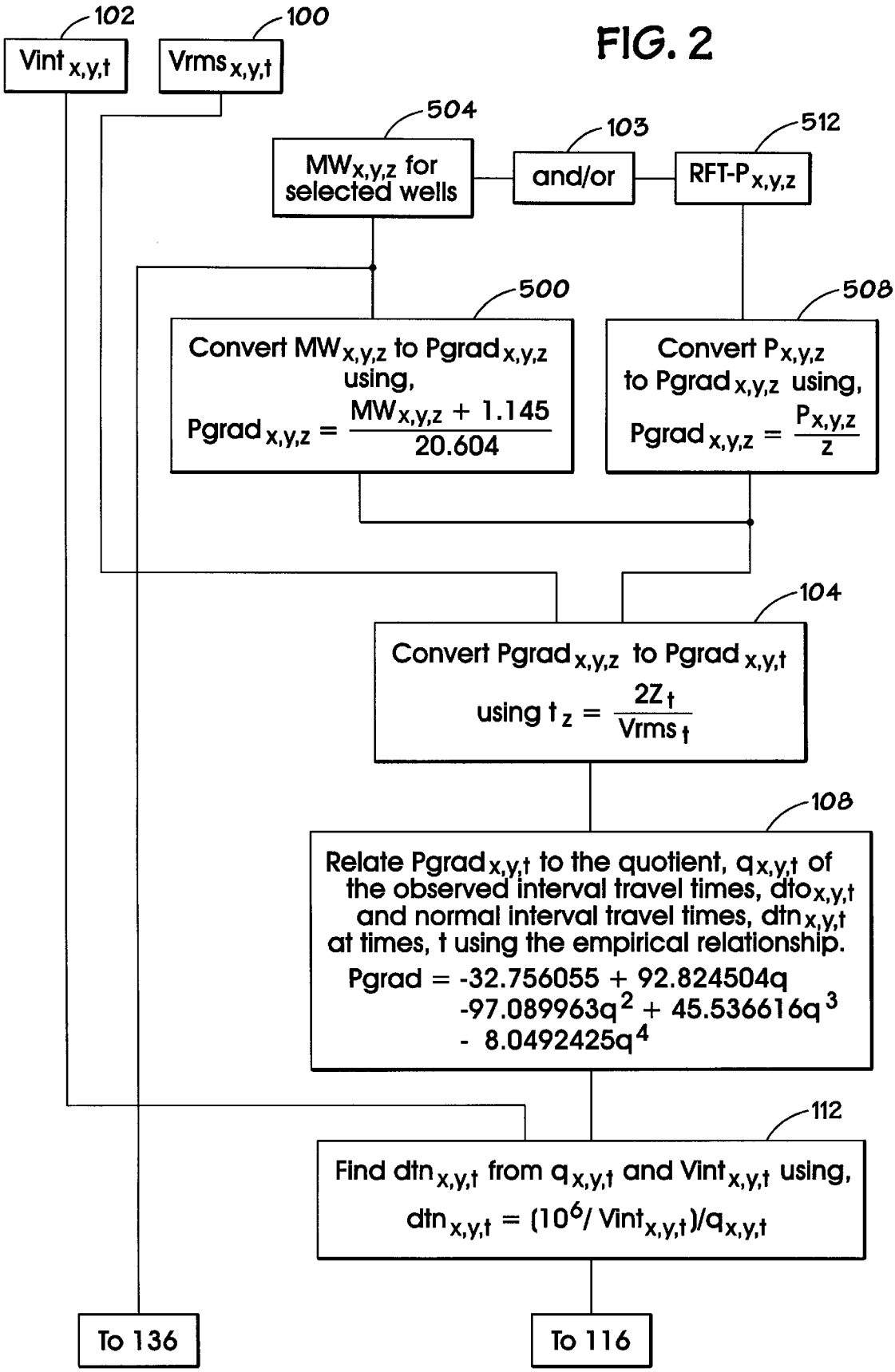
FIG. 2
102
Vint x,y,t
100
Vrms x,y,t
504
MWx,y,z for selected wells
103
and/or
512
RFT-Px,y,z
500
Convert MWx,y,z to Pgrad x,y,z using,
Pgrad x,y,z = (MWx,y,z + 1.145)/20.604
508
Convert Px,y,z to Pgrad x,y,z using,
Pgrad x,y,z = Px,y,z/z
104
Convert Pgrad x,y,z to Pgrad x,y,t
using t z = 2Z t/Vrms t
108
Relate Pgrad x,y,t to the quotient, qx,y,t of the observed interval travel times, dtox,y,t and normal interval travel times, dtnx,y,t at times, t using the empirical relationship.
Pgrad = -32.756055 + 92.824504q -97.089963q2 + 45.536616q3 - 8.0492425q4
112
Find dtnx,y,t from qx,y,t and Vintx,y,t using,
dtnx,y,t = (106/ Vintx,y,t)/qx,y,t
To 136
To 116

METHOD FOR PREDICTING PORE PRESSURE IN A 3-D VOLUME

BACKGROUND OF THE INVENTION

This invention relates to the processing of seismic data to aid in predicting pore pressure, and, more particularly, to the processing of three-dimensional (3-D) seismic data to aid in predicting pore pressure of a subsurface underneath a region of a floor of an ocean, from a surface of the ocean above the floor.

A pore pressure gradient is a measure of the change in the pressure exerted on fluids, in the pores of buried rocks, as a function of depth. Pore pressure gradients vary as a function of depth of burial, depositional history, compaction, mineralogy, and other environmental conditions. A normally (i.e., hydrostatically) compacted pressure section has a pore pressure gradient equal to that of a water column which permeability does not impede. Sections where the flow of pore fluids are restricted, by whatever mechanism, are called under-pressured, over-pressured, abnormally pressured, or geopressured.

An empirical relationship between seismic interval velocity and the pore pressure gradient is useful for predicting pore pressure gradients in areas where direct measurements are impractical (such as beneath the ocean floor). Seismic migration velocities are a precise measure of a specific average velocity type called Root Mean Squared (RMS) velocities. From RMS velocity, interval velocity, the average velocity over a specified interval, is calculated.

Experience has shown that the pore pressure gradient relates to interval velocity, and that the logarithm of the interval travel time (reciprocal of interval velocity as defined above) linearly relates to the logarithm of depth for the normally pressured regions of the subsurface. Over-pressured sections exhibit the same linear slope as normally pressured sections, but differ in intercept.

U.S. Pat. No. 5,343,440 to Kan et al. discloses a two-dimensional (2-D) geopressure analysis system. U.S. Pat. No. 5,128,866 to Weakley discloses a one-dimensional (1-D) pore pressure prediction method. However, neither Kan et al. nor Weakley disclosure a method for generating a 3-D pore pressure prediction or calibration field.

What is needed is a method which utilizes empirical relationships in order to predict the magnitude of the pore pressure gradient as a function of depth, latitude, and longitude.

SUMMARY OF THE INVENTION

The pore pressure prediction method of the present invention includes the processes of: (a) designing a normal compaction trend velocity model over a 3-D survey area; (b) testing the normal compaction trend velocity model; (c) designing 3-D spatial adjustment parameters to compensate for water depth; and (d) processing a 3-D velocity field using an interpreted normal compaction trend velocity model and the 3-D spatial adjustment parameters.

In another feature of the method, the process of designing the normal compaction trend velocity model includes the following steps. In a first step, the process converts measurements of specific gravity of drilling mud samples into a pore pressure gradient. In another step, the process calculates a quotient function, which is the normal compaction trend velocity function divided by a corresponding observed interval velocity function. In another step, the process, using the quotient function and the observed interval velocity function, calculates a modeled normal velocity function. In another step, the process calculates a pore pressure gradient by using the quotient function and a nonlinear, empirically-developed polynomial expression. In another step, the process displays normal compaction trend data for visual interpretation by creating a scatter plot of values or data points.

In another feature of the method, the process of testing the normal compaction trend velocity model includes the following steps. In a first step, the process visually interprets these data points by evaluating several possibilities. For data points that do not fit the general trend of the straight line, the process reexamines them with regard to recorded comments, found on scout tickets, of a drilling engineer or a mud logger, and subjectively edits or omits the datum point in question. The process interprets the reliability of the questionable datum point, and typically, if a single datum point does not fall on the straight line, the process deletes it. In another step, after editing, the process regresses the logarithm of values for the normal compaction trend interval travel time on the logarithm of depth, synthesizes a straight line, and displays the straight line.

A technical advantage of the invention is that the method provides a procedure for predicting pore pressure in a 3-D volume from a 3-D volume of seismic interval velocities, thus enabling the design of well-site engineering parameters.

Another technical advantage is that the method implements calibration in 3-D, thus allowing an analyst to integrate multiple wells into a pressure volume prediction.

Another technical advantage is that the 3-D pore pressure results help analysts understand the nature of regional seals and barriers to pore fluid migration.

BRIEF DESCRIPTION OF THE DRAWINGS

FIGS. 2 and 3 show a flowchart of the first process of the method of the invention.

FIGS. 2 through 8 taken together, represent a single flowchart of the method of the invention.

DETAILED DESCRIPTION OF THE PREFERRED EMBODIMENT

Figure 1:
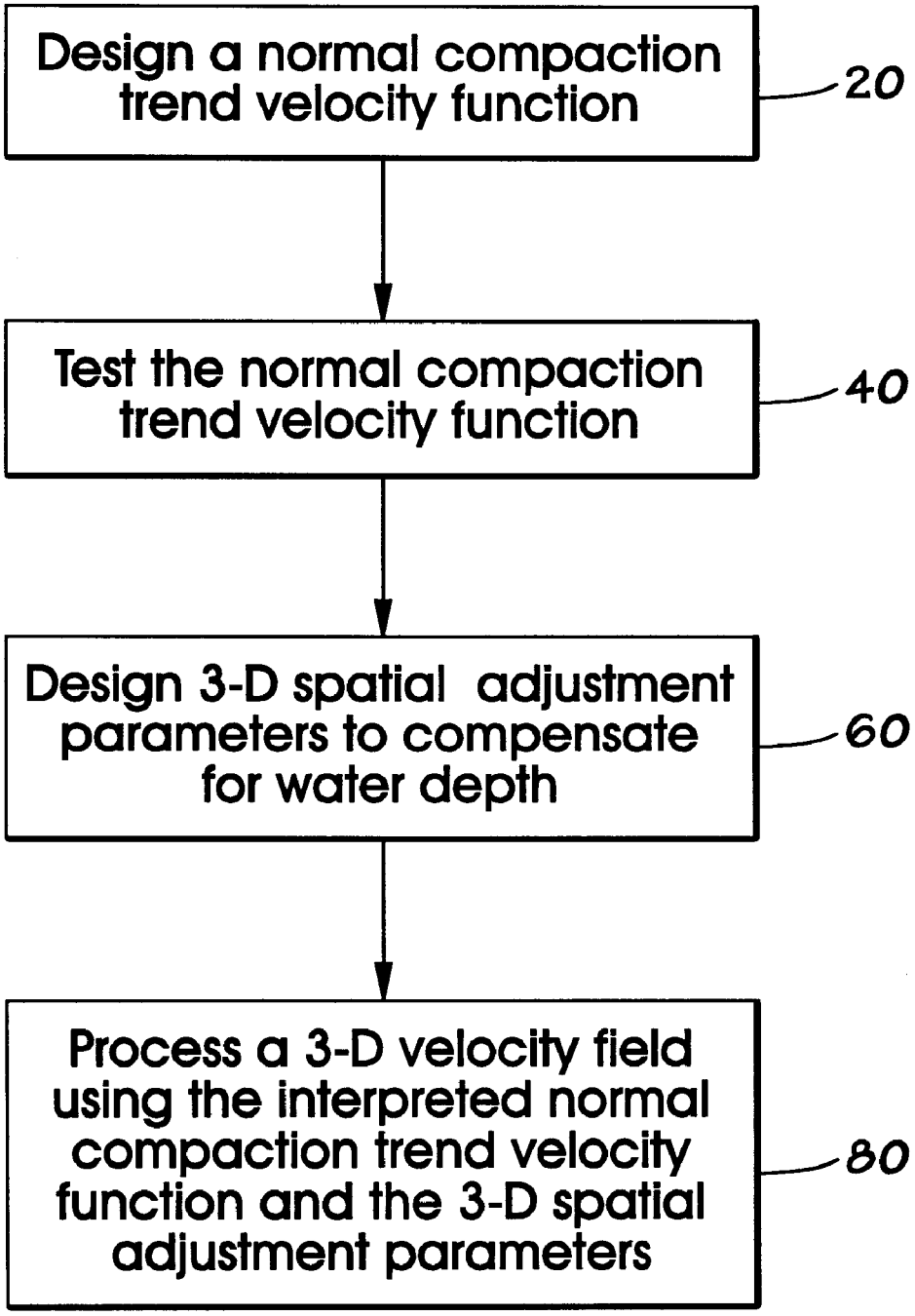
FIG. 1 is a flow chart showing the overall view of the method of the invention.

Referring now to FIG. 1, a method of predicting pore pressure is disclosed which includes four processes 20, 40, 60, and 80. The first process 20 designs a normal compaction trend velocity function over a 3-D survey area. The second process 40 tests the normal compaction trend velocity function. The above processes 20 and 40 are carried out by hand and with the aid of a spreadsheet program, such as "MICROSOFT EXCEL". The third process 60 designs 3-D spatial adjustment parameters to compensate for water depth, using seismic processing algorithms that are commonly known in the art, as part of an analyst's "tool kit". The fourth process 80 processes a 3-D velocity field by inputting the normal compaction trend velocity function, as interpreted, and the 3-D spatial adjustment parameters into computer programs which process a result.

Figure 3:
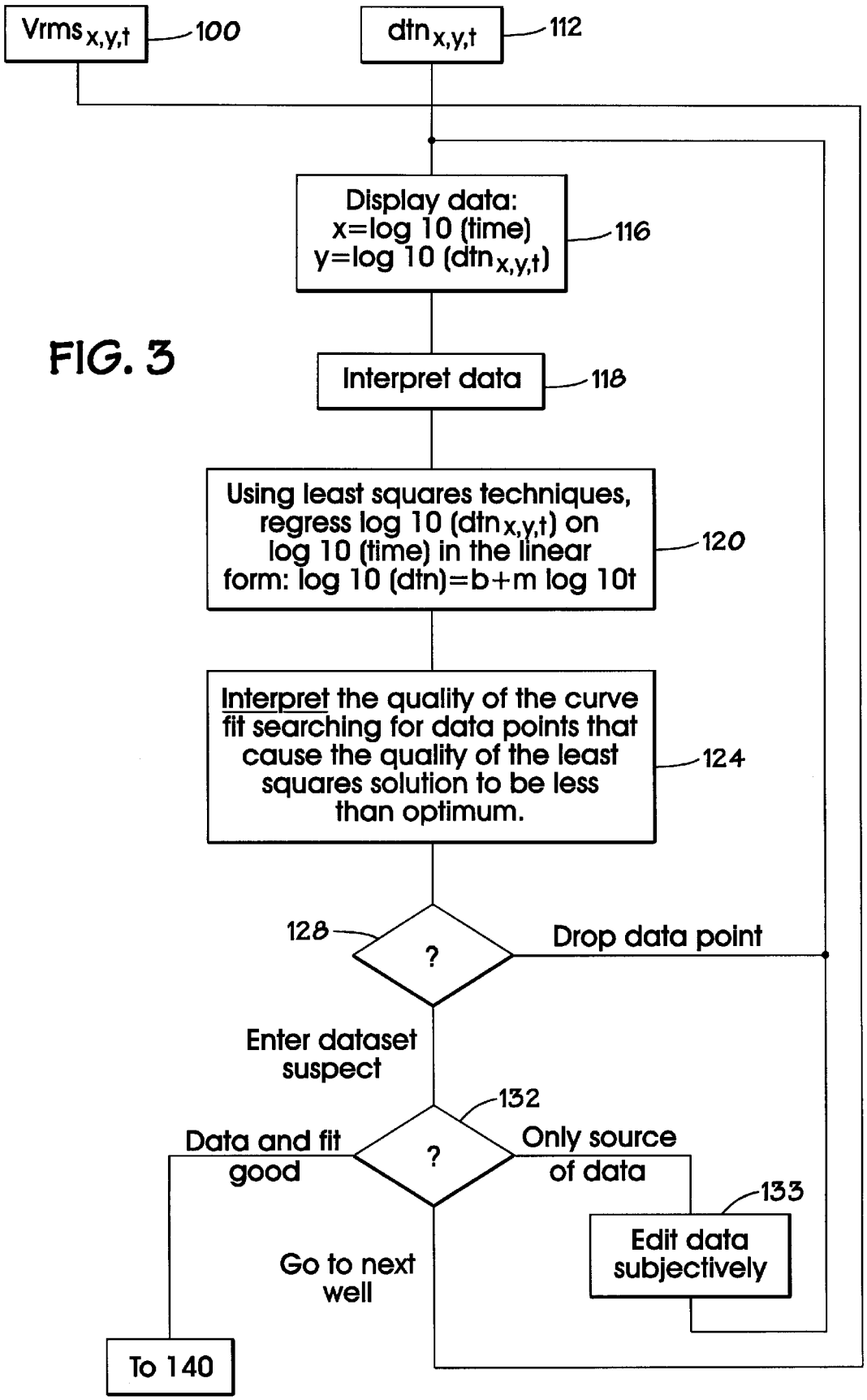

Referring now to FIGS. 2 and 3, the process 20, designing a normal compaction trend velocity function, involves several steps. In step 102, the process converts average velocity estimations into interval velocity estimations $Vint_{x,y,z}$, using a method, commonly known in the art, which calculates Vint using the relationship:

$$Vint=[(V_n 2t_n-V^2_{n-1}t_{n-1})/(t_n-t_{n-1})]^{1/2},$$

where

Vint is the interval velocity between layers n and n−1. Interval velocity is the average velocity across an interval, and may be a depth or a time interval;

$V_n$ is the average velocity at layer n;

$t_n$ is the two-way acoustic travel time to layer n;

$V_{n-1}$ is the average velocity at layer n−1; and $t_{n-1}$ is the two-way travel time to layer n−1.

In step 103, the analyst decides between a first and a second algorithm to use to convert measurements of specific gravity of drilling mud samples into pore pressure gradients or direct pore pressure measurements and depth into pore pressure gradients. The first algorithm 500 utilizes the following empirical relationship:

$$P_{GRADxyz}=(MW_{x,y,z}+1.145)/20.604$$

where, $P_{GRADx,y,z}$ is the pore pressure gradient in pounds per square inch per foot of depth; and $MW_{x,y,z}$ 504 is the mud weight or specific gravity of the drilling mud used at a well located at x, y, and at depth z, measured in pounds per gallon.

The second algorithm 508 uses direct pore pressure interpretations from Repeat Formation Tester (RFT) measurements 512 to directly calculate pore pressure gradient. The relationship is:

$$P_{GRADx,y,z}=P_{x,y,z,}/Z$$

where $P_{GRADx,y,z,}$ is the pore pressure gradient in pounds per square inch per foot of depth, $P_{x,y,z,}$ is the pore pressure which the process interprets from an RFT measurement at depth Z, and Z is the true vertical depth to the point where the RFT measurement was taken.

In either or both the above algorithms 500 or 508, the desired parameter is the precise pore pressure gradient at each measurement point Z in the well.

In step 104, the process uses the equation $t_z=2Z_t/VRMS_t$ to convert the pore pressure gradient $Pgrad_{x,y,z,}$ into $Pgrad_{x,y,t}\cdot Vrms_{x,y,t}$, the root mean squared velocity at location x, y, and at time t from seismic processing, is an input. In step 108, the process relates the $Pgrad_{x,y,t}$ to the quotient function $q_{x,y,t}$ of observed interval travel times $dto_{x,y,t}$ (the reciprocal of observed interval velocity) and normal interval travel times $dtn_{x,y,t}$ (the reciprocal of the normally compacted pressure section velocity as defined above) at times t, using the empirical relationship which follows:

$$Pgrad=-32.756055+92.824504q-97.89963q^2+45.5336616q^3-8.049Z425q^4.$$

The process solves this empirical relationship for the quotient $q_{x,y,t}$.

In step 112, the process calculates $dtn_{x,y,t,}$ the interval travel time of a normally compacted geologic section at location x, y, and at times t, from the quotient function $q_{x,y,t}$ and the interval velocity function $Vint_{x,y,t,}$ using the relationship $dtn_{x,y,t}=(10^6/Vint_{x,y,t})/q_{x,y,t}$. $Vint_{x,y,t}$ represents estimations of the observed interval velocity function calculated above.

Now referring to FIG. 3, in step 116, the process displays $dtn_{x,y,t}$ on a graph, having calculated the abscissa of each value as $x=\log_{10}(t)$, and the ordinate calculated as $Y=\log_{10}(dtn_{x,y,t})$. In step 118 the process interprets the data. In step 120, using least square techniques, the process regresses the $\log_{10}(dtn_{x,y,t})$ on $\log_{10}(t)$ in the linear form $\log_{10}(dtn)=b+m\log_{10}(t)$.

Figure 4:
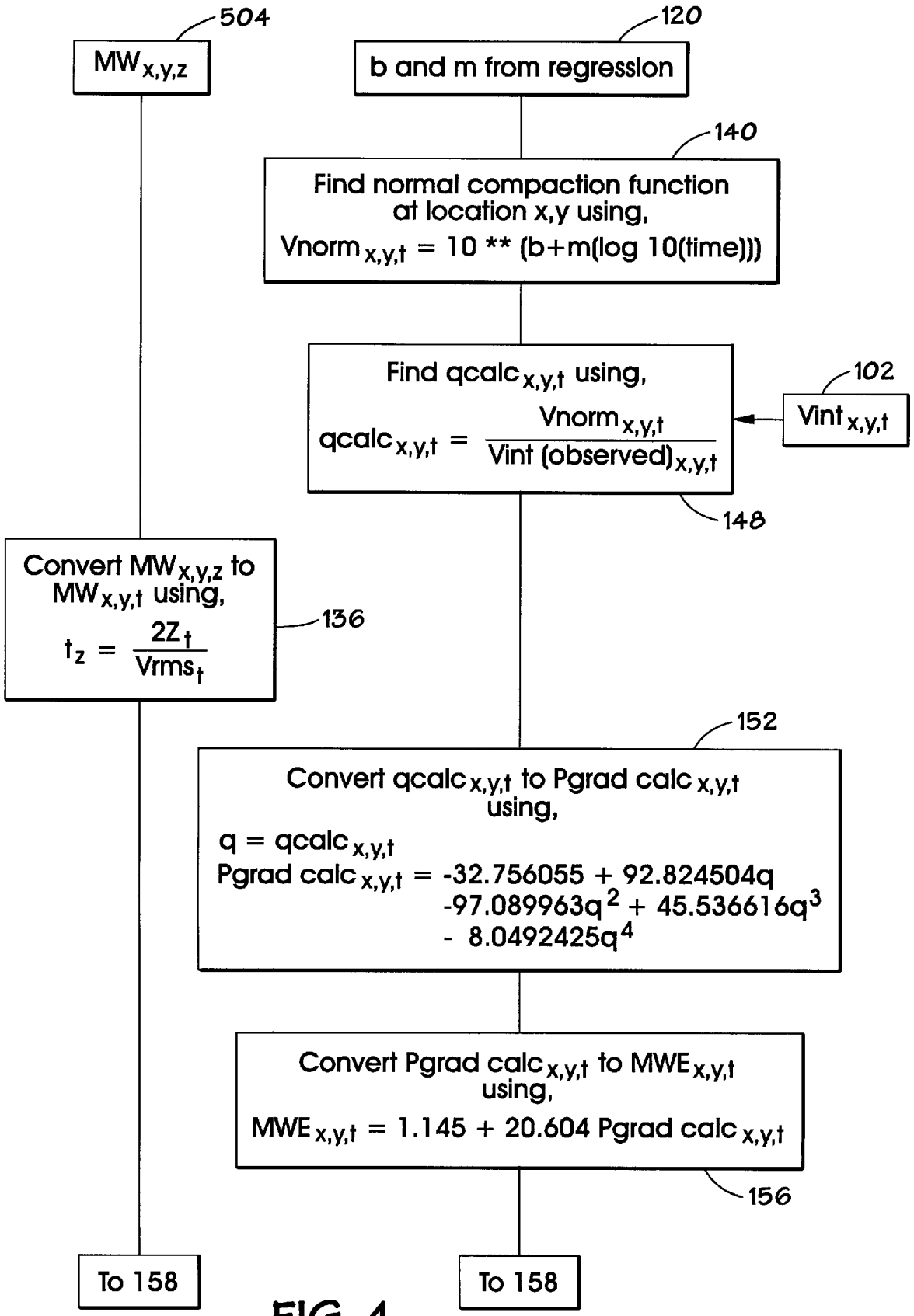
FIGS. 4 through 5 show a flowchart of the second process of the method of the invention.
Figure 5:
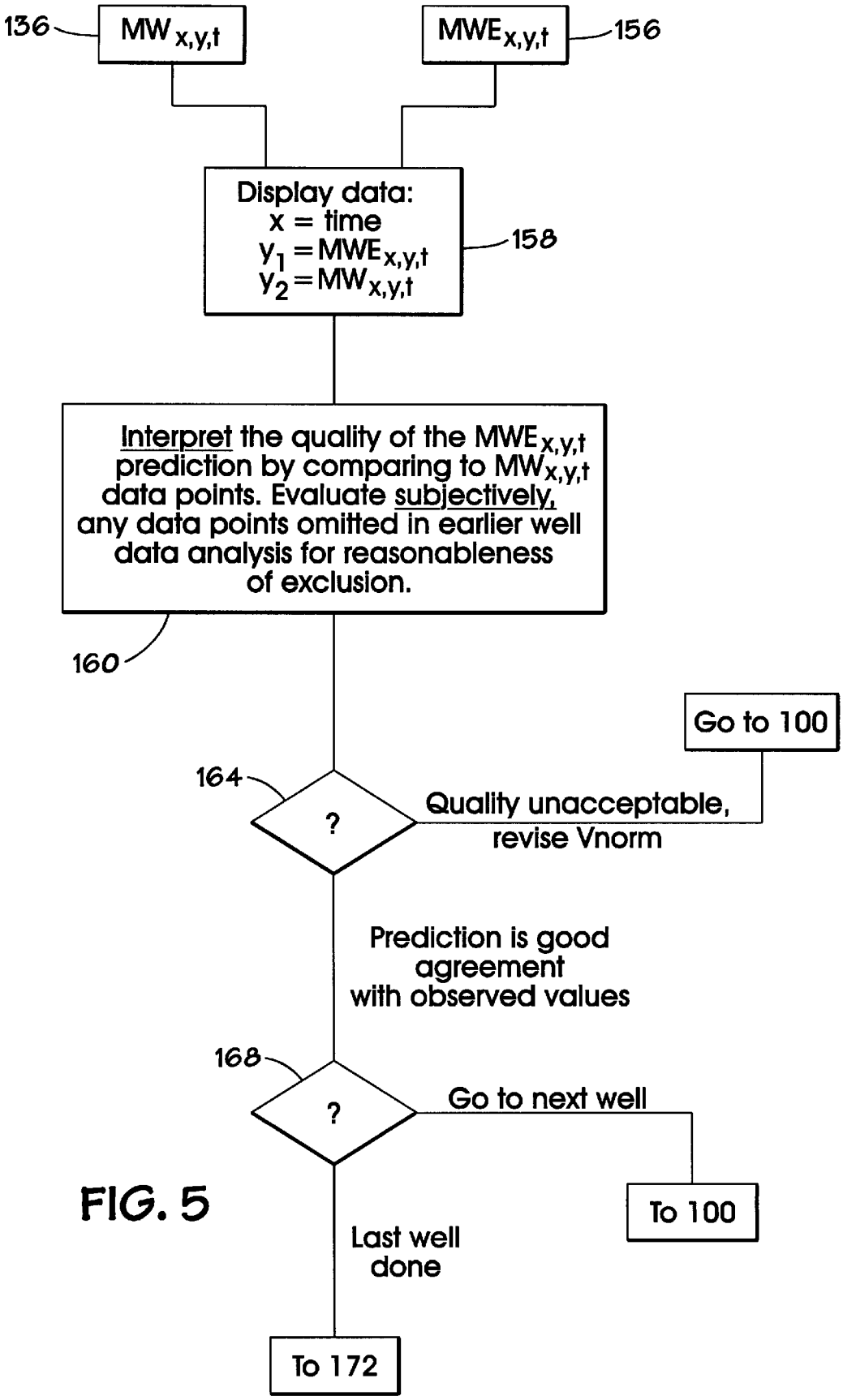

Now referring to FIGS. 3–5, the second process tests the normal compaction trend velocity function. In step 124, the analyst interprets the quality of the curve fit, searching for data that cause the quality of the least squares solution to be less than optimum. In step 128, prior to passing corresponding datasets on for iteration, or on for further processing, the analyst must consider whether he should drop certain data, whether the entire dataset is suspect, or whether the dataset is acceptable. In step 132, if the set of data points is acceptable or represents the only source of data (whether or not the dataset is suspect), the analyst must either (a) subjectively edit the set of data points (step 133) and resubmit the data points for graphing in step 116 above, (b) pass the set of data points and resulting regression on to step 140 as the normal compaction trend velocity function, or, if the process has not completed steps 100 to 132 on all the wells, (c) repeat steps 100 to 132 on the next well. Typically two to five wells are used.

In step 136, the process converts $MW_{x,y,z}$ to $MW_{x,y,t}$ for selected wells using the relationship $t_z=2Z_t/Vrms_t$ (as in step 104, above). These values are inputs to step 158 (shown in FIG. 5), described in more detail below. In step 140, the intercept b and the slope m, from the regression of step 120, above, are inputs for calculating $V_{NORMx,y,t}$, the normal compaction trend velocity function at location x and y, using the relationship $V_{NORMx,y,t}=10^{(b+m(log10(t)))}$.

In step 148, the process calculates $q_{calc}$ by dividing $V_{NORMx,y,t}$, as calculated in step 140, by $Vint(observed)_{x,y,t}$, the interval velocity at location x, y, and 2-way seismic travel time t, which a technician observes, as input in step 112, above.

In step 152, the following nonlinear relationship, $$Pgrad_{calcx,y,t}=-32.756055+92.824504q-97.089963q^2+45.536616q^3-8.049242425q^4,$$

converts $q_{calcx,y,t}$ to $Pgrad_{calcx,y,t}$, where $q=q_{calcx,y,t}$, from step 148.

In step 156, the relationship $MWE_{x,y,t}=1.145+20.604\ Pgrad_{calcx,y,t}$ converts $Pgrad_{calcx,y}$ to $MWE_{x,y,t}$. $Pgrad_{calc}$ is the predicted pore pressure gradient in pounds per square inch per foot of depth. $MWE_{x,y,t}$ is the mud weight equivalent at location x, y, and at two-way travel time t.

In step 158, a monitor displays $MW_{x,y,t}$, the mud weight from step 136, above, and $MWE_{x,y,t}$, the mud weight equivalent from step 156, above, where $y_1=MWE_{x,y,t}$ and $y_2=MW_{x,y,t}$, and x=two-way travel time. In step 160, the analyst visually interprets the quality of the $MWE_{x,y,t}$ prediction in step 158, above, by comparing it to $MW_{x,y,t}$ data point from step 136, and then subjectively evaluating any data points which the analyst omitted in earlier well data analysis, such as in steps 124–132, in order to determine whether he reasonably excluded such data. There should be good agreement between the line predicted by the above mud weight equivalent formula and the measured or observed mud weight data points from step 504, above. If representative of actual pressure gradients in the subsurface, the data will agree within ½ lb/gal. MWE.

In step 164, the analyst interprets the data points, displayed in step 158, to verify that all observed mud weight data points from step 504 are acceptably near a line representing the predicted mud weight data from step 156 above. A good quality prediction lends confidence to proceed with the 3-D pore pressure prediction. Discrepancies between observed data values and the predicted mud weight equivalent line are reason for iteration and reevaluation. Visual interpretation of these data points, while representing the mud weight used, may not be representative of the actual pore pressure gradient in the subsurface. The analyst reexamines points that do not fit the general trend of the line with regard to recorded comments, found on scout tickets of a drilling engineer and/or a mud logger. The analyst makes an interpretation regarding the reliability of any questionable datum points. The analyst considers possible explanations including whether: 1) the datum point represents the drilling engineer's expectation of abnormal pressure rather than reality; 2) the datum point is correct, and the surrounding data points are suspect; or 3) the lithology encountered is other than an assumed sand-shale sequence-for example, salt. Most typically, if a single datum does not fall near the line, the analyst deletes it. Thus such data does not contribute (destructively) to the quality of a statistical analysis. If the quality is unacceptable, the analyst revises the $V_{NORM}$ through iteration and returns to step 100. If the prediction is in good agreement with observed values, then the process proceeds to step 168. In step 168, the processing proceeds to the next well, step 100, or, if the process has just completed processing with respect to the last well, the process proceeds to the third process.

Figure 6:
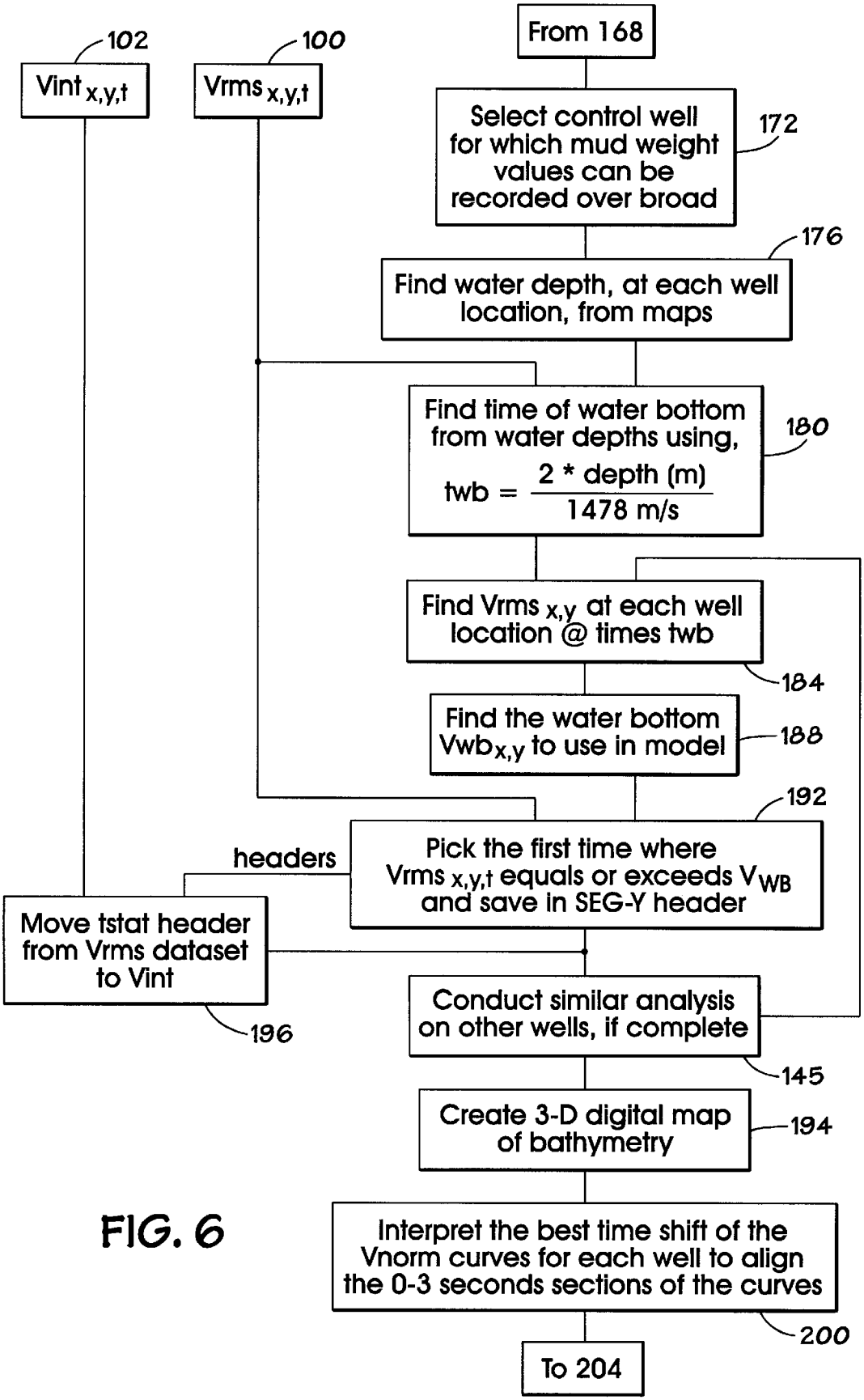
FIGS. 6 and 7 show a flowchart of the third process of the method of the invention.
Figure 7:
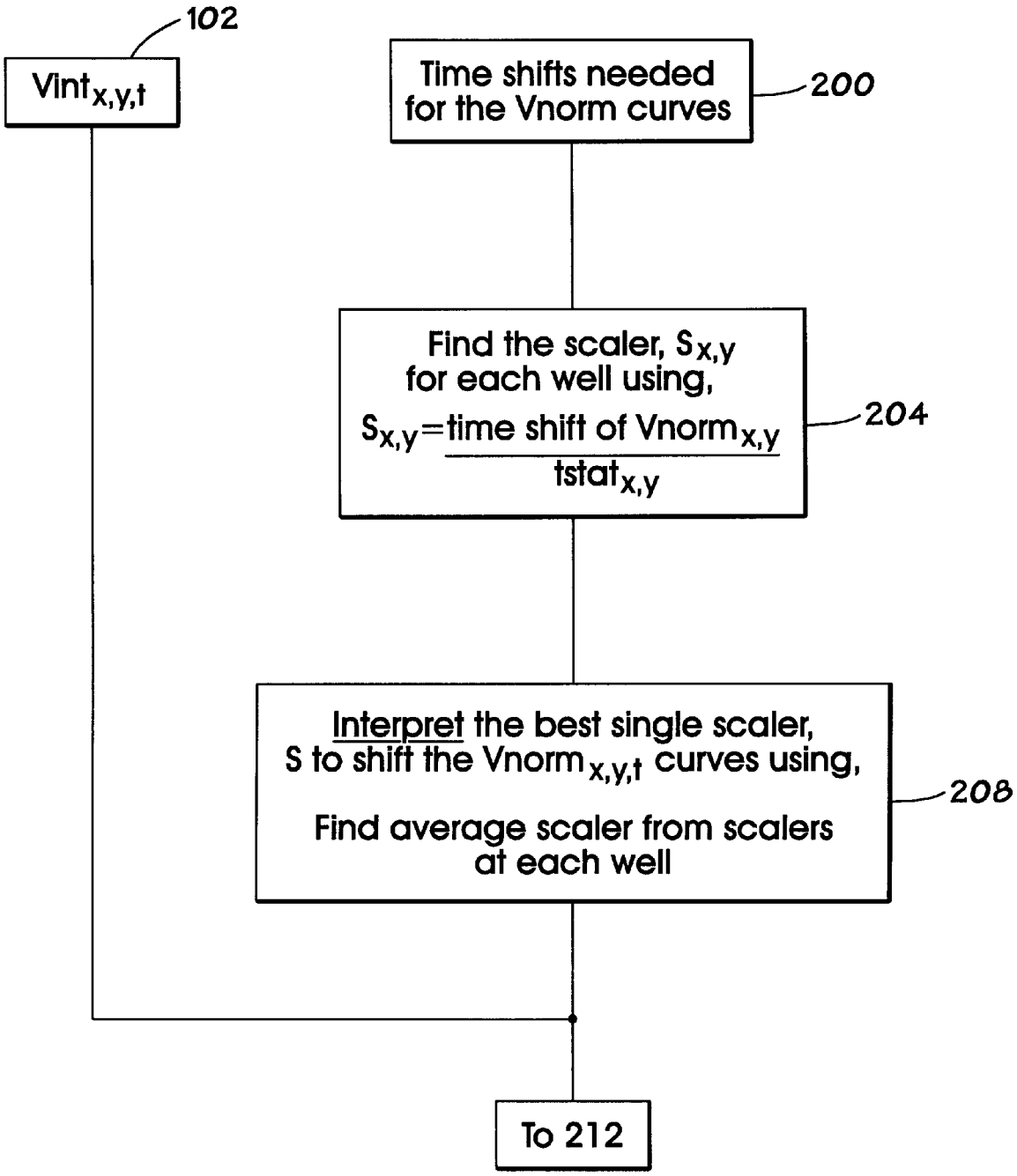

Referring now to FIGS. 6 and 7, the third process designs 3-D spatial adjustment parameters, such as a time to water bottom for a control well, a scalar constant, and time shifts, described in more detail below, to compensate for water depth. In step 172, the process selects a control well for which the analyst can record mud weight values over a broad range of sample depths in the control well. This well should be ideally located in shallow (less than 60 meters) water. In step 176, the process finds the water depth at the well location from maps, charts, or well reports. In step 180, the process calculates a Time of Water Bottom (the two-way travel time which an acoustic signal takes to travel from sea level to the ocean floor and reflect back to sea level) using the water depth by dividing (2z) by 1478 m/s, where z is the water depth in meters and 1478 m/s is the velocity of sea water. In step 184, the process uses the relationship described above in step 136, for $Vrms_{x,y,}$ in order to find $Vrms_{x,y,t}$ at each well location at times $t_{wb}$. This is accomplished by finding the observed velocity of sea water ($V_{WB}$) at the well location. The observed average velocity is measured at the acoustic two-way travel time from an average velocity functions found in seismic trace processing. In step 188, the process finds the observed velocity of sea water, $Vwb_{x,y}$, corresponding to the selection made in step 172, above. In step 192, the process records the observed velocity of sea water at the ocean floor, and uses it to pick the approximate time of the sea floor reflection throughout the 3-D survey area. This is accomplished by examining each function in a set of average velocity data prints, finding the first occurrence, after time zero, of the observed sea water velocity ($V_{WB}$) where $Vrms_{x,y,t}$ equals or exceeds VWB, and saving this time in a header word named "tstat" (a mnemonic for "total static"), in an SEG-Y standard format for use in building the 3-D velocity model. In step 145 a similar analysis is conducted on other wells, if complete. This process thus generates, in step 194, a 3-D map of bathymetry. The process then repeats step 192 for all velocity functions throughout the 3-D survey area.

A SEG-Y header word is a combination of digital bits, typically 4, 8 bit nibbles, that contain a number. Each seismic trace in SEG-Y format has 240 bytes of "header" storage associated with it. The 240 8 bit bytes comprise a number of "header words" according to the SEG standard, SEG-Y. The words are referred to via their byte location or via a mnemonic such as tstat.

In step 196, the process moves the tstat header word from the set of Vrms data points used in step 104, to a set of Vint data points in preparation for later processing. In step 200, the analyst interprets the best temporal shift of the curves for each well in order to align sections of the curves referred to as the 0–3 second two-way time sections. The analyst conducts similar analyses at other selected wells within the confines of the 3-D survey area. In general, the shape of the normal compaction trend velocity function should remain somewhat constant from well to well with the exception of a temporal shift. The process compares the normal compaction trend velocity function found at the control well in shallow water to the normal compaction trend velocity functions found at other well locations. The process measures and records the temporal shifts which are necessary to align the functions.

Referring now to FIG. 7, in step 204, the process calculates a scalar constant that will cause the observed normal compaction trend velocity function at each location to match the control well function. The process uses the average of these scalar constants to process the data. The analyst finds the average scalar constant, "$S_{x,y}$ bar", for each well, using the relationship $$S_{x,y}=(\text{time shift of } V_{NORM\ x,y})/\text{tstat}_{x,y}$$

In step 208, the analyst interprets the best single scalar constant S bar, to shift the $V_{NORMx,y,t}$ curves using the following relationship:

$S_{x,y}$=a summation of wells from i to the number of wells of $S_{x,y,}$ the summation being divided by the total number of wells.

Testing in various areas of the Gulf of Mexico indicates that this value is approximately 1.5.

Figure 8:
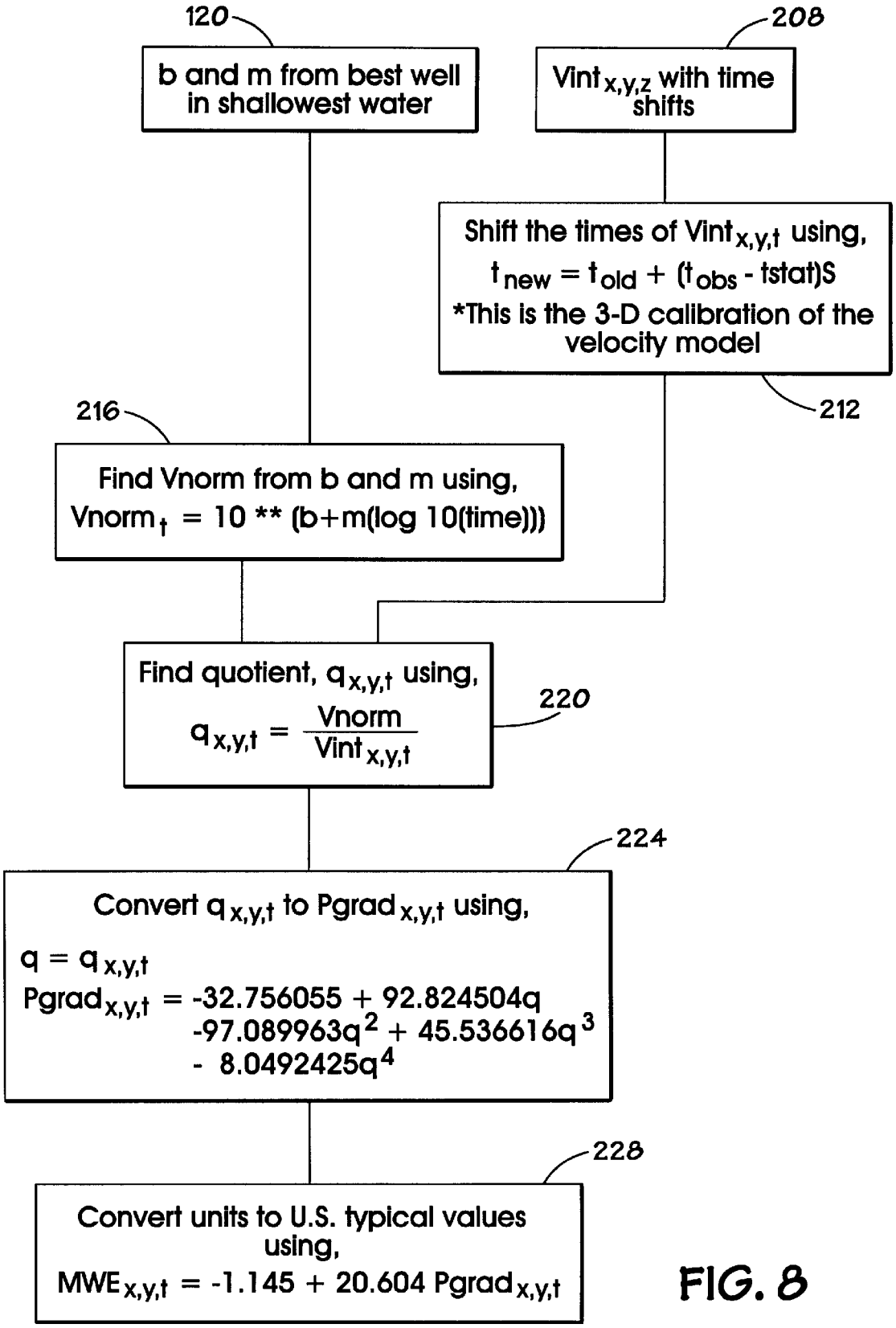
FIG. 8 shows a flowchart of the fourth process of the method of the invention.

Referring now to FIG. 8, the fourth process processes the 3-D velocity field using the normal compaction trend velocity function of step 140, as interpreted in steps 160–164, and the 3-D spatial adjustment parameters by following, roughly in reverse, the series of steps of the first process, that of designing the normal compaction trend velocity function. In step 212, the process adjusts each velocity function, first statically, then dynamically, in order to compensate for water depth. The process subtracts the time to the water bottom at the shallow control well from the two-way travel time for the function under consideration. The process scales the two-way time to the sea floor using the scalar constant of step 208, designed from multiple wells in the area. Again, a typical value of this scalar is 1.5. The process adds back to the function the two-way travel time of the water bottom reflection at the control well in order to compensate for varying water depth, thus completing a first stage of spatial adjustment of the velocity volume. The analyst shifts the times of $Vint_{x,y,t}$, from step 196 above, using the relationship $$t_{new}=t_{old}+(t_{obs}-tstat)(S\ \text{bar}),$$

where $t_{new}$ is the time with shift applied;

tstat is the observed surface-to-sea-floor, two-way time at the control well;

S bar is the average scalar constant; and $t_{obs}$ is the observed surface-to-sea-floor two-way time being adjusted.

This represents a 3-D calibrated velocity model. In step 216, the process uses the slope m and intercept b of the calculated normal compaction trend velocity function and average shift scalar constants, in conjunction with the 3-D digital map of bathymetry, generated in the third process, to spatially perturb the normal compaction trend velocity function. The process selects the b and the m from the best well in the shallowest water, the values for b and m being input into the equation $V_{NORMt}=10^{(b+m(log10(time)))}$ in order to find $V_{NORMt}$.

In step 220, $Vint_{x,y,z}$, with time shifts from step 212, are input into the following relationship, in order to calculate a quotient q:

$$q_{x,y,t}=V_{NORMt}/Vint_{x,y,t}$$

The quotient q is the ratio of the interval travel time of the normal compaction trend velocity function of step 140, as interpreted, and the observed interval travel time, as input in step 108, for example. The quotient q is unitless because the velocity and/or interval travel time units in the numerator and denominator must be the same.

In step 224, the process converts $q_{x,y,t}$ to $Pgrad_{x,y,t}$ using the following non-linear, empirical, polynomial relationship:

$$Pgrad_{x,y,t}=-32.756055+92.824504q-97.089963q^2+45.536616q^3-8.0492425q^4,$$

where $q=q_{x,y,t}$. This represents the 3-D pore pressure gradient.

In step 228, the process converts the units to typical U.S. units using the following empirical relationship:

$$MWE_{x,y,t}=-1.145+20.604Pgrad_{x,y,t}.$$

This 3-D data volume of mud weight equivalent is the final pore pressure gradient prediction. This concludes the processes of the method of the invention.

An advantage of the invention is that the method provides a procedure for predicting pore pressure in a 3-D volume from a 3-D volume of seismic interval velocities, thus enabling the design of well-site engineering parameters.

Another advantage is that the method implements calibration in 3-D, thus allowing an analyst to integrate multiple wells into a pressure volume prediction.

Another advantage is that the 3-D pore pressure results help analysts understand the nature of regional seals and barriers to pore fluid migration.

In another embodiment, a substitute step may replace step 220 above. In the substitute step, the process finds the quotient from interval travel times which the process calculated from the velocities. In this case, the solution is, $$DT_{NORM}=10^6/V_{NORM}$$

$$DT_{OBS}=10^6V_{OBS}$$

$$Q=DT_{OBS}/DT_{NORM}$$

where,

Q is the quotient of the ratio;

$V_{NORM}$ is the normal compaction trend velocity function;

$V_{OBS}$ is the observed interval velocity function;

$DT_{NORM}$ is the normal compaction trend interval travel time function;

$DT_{OBS}$ is the observed interval travel time function.

Although illustrative embodiments of the invention have been shown and described, the inventor contemplates a wide range of modification, changes, and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of predicting pore pressure of a subsurface in a 3-D survey area underneath a region of a floor of an ocean, using measurements from a series of wells, the method comprising the processes of:

a. designing a normal compaction trend velocity model;

b. testing the normal compaction trend velocity model;

c. designing 3-D spatial adjustment parameters to spatially adjust and compensate for water depth; and d. processing a 3-D velocity field using the normal compaction trend velocity model, as interpreted, and the 3-D spatial adjustment parameters.

2. The method of claim 1, wherein the process of designing the normal compaction trend velocity model, includes the steps of:

a. converting measurements of specific gravity of drilling mud samples into pore pressure gradient;

b. calculating an average velocity to each depth point in seismic trace data processing;

c. calculating an observed interval velocity;

d. calculating a quotient, which is the normal compaction trend velocity function divided by an observed interval velocity;

e. from the quotient and the observed interval velocity, calculating a modeled normal velocity;

f. calculating the pore pressure gradient by using a nonlinear, empirically-developed polynomial expression; and g. displaying normal compaction trend data for visual interpretation by creating a scatter plot of values.

3. The method of claim 2, wherein the step of displaying normal compaction trend data for visual interpretation is accomplished by creating a scatter plot of values with the logarithm (base 10) of an acoustic travel time to and from the sea floor along one axis and the logarithm (base 10) of interval travel times of the normal compaction trend velocity function along another axis.

4. The method of claim 1, wherein the process of testing the normal compaction trend velocity model includes the steps of:

a. visually interpreting data points, consisting of travel time and two-way travel time values of the normal compaction trend velocity function, by evaluating at least one of the following:

(1) if the data points are representative of actual pressure gradients in the subsurface, a plot of the log(10) of the data points will generally follow a straight line;

(2) the data points, while representing mud weight, may not be representative of the pore pressure gradient in the subsurface;

(3) for data points that do not appear to generally follow the straight line, reexamine with regard to comments which a drilling engineer noted, as found on scout tickets;

(4) interpreting each individual datum point of the data points which do not appear to generally follow the straight line in order to ascertain the datum point's reliability, considering at least one of the following possible solutions:

(a) the datum point represents the drilling engineer's expectation of abnormal pressure rather than reality;

(b) the datum point is correct and the surrounding data are suspect;

(c) the lithology encountered is other than an assumed sand-shale sequence;

(d) if a datum point does not fall on the straight line, consider deleting the datum point so that it does not adversely affect the quality of the normal compaction trend velocity function;

b. after editing, (1) regressing a logarithm of travel time values of the normal compaction trend velocity function on a logarithm of the two-way travel times using standard least squares linear regression techniques, (2) synthesizing a straight line, superimposed on data points, using a slope and an intercept which resulted from this analysis; and (3) displaying the straight line superimposed on data points;

c. reinterpreting the data points to verify that all data points are acceptably near the synthesized straight line which represents a least squares best fit; if unacceptable observations are noted, consider iteration; if fit is acceptable, move to next step;

d. from the intercept and the slope resulting from the least squares best fit above, generating a normal compaction trend velocity function;

e. calculating a predicted quotient function, thus yielding a calculated quotient function;

f. predicting a pore pressure gradient from the calculated quotient function using an empirical, nonlinear, polynomial expression;

g. converting the pore pressure gradient, predicted in the step f above, to units of mud weight equivalent;

h. interpreting the relationship between predicted mud weight equivalent data, from step g above, and mud weight data, measured at the well locations;

i. determining whether there is good agreement between a line representing the predicted mud weight equivalent data points and the mud weight data, measured at the well locations;

j. evaluating any observed disagreement to evaluate possible reasons for the disagreement; and k. repeating the above process steps for all wells.

5. The method of claim 1, wherein the process of designing the 3-D spatial adjustment parameters to compensate for water depth involves the steps of:

a. selecting a control well at a given location, ideally in shallow water of a depth of less than 60 meters, and recording mud weight values over a broad range of sample depths in the control well;

b. calculating two-way travel times for the water depth at the given location using an observed acoustic two-way travel time to and from the sea floor and the velocity of sea water;

c. examining an average velocity function at the well location at the time of sea floor reflection;

d. calculating acoustic, two-way travel times for all of mud weight samples and pore pressure gradient values using a true vertical depth associated with each measurement and an average velocity between a surface of the ocean and each depth point;

e. calculating and recording the average velocity of sea water at the ocean floor and using it to pick an approximate time of sea floor reflection, a value used throughout the 3-D velocity field under study;

f. examining each function in the set of average velocity data points and finding a first occurrence, after time zero, of the velocity with respect to the control well;

g. from these data, creating a 3-D digital map of bathymetry;

h. observing and recording temporal shifts which are necessary to align the functions;

i. calculating a scalar constant that will cause an observed interval velocity function to match an interval velocity function of the control well at each location;

j. averaging scalars at each well location to calculate an average shift scalar constant; and k. from the slope and the intercept of the calculated normal compaction trend velocity function and the average shift scalar constants, in conjunction with the 3-D digital map of bathymetry, spatially perturbing the normal compaction trend velocity function.

6. The method of claim 5, wherein the process of processing the 3-D velocity field, using the normal compaction trend velocity model, as interpreted, and the 3-D spatial adjustment parameters, includes the steps of:

a. adjusting each velocity function, first statically then dynamically, to compensate for water depth;

(1) subtracting a time to water bottom reflection at the control well from the two-way travel time for the velocity function;

(2) scaling the two-way travel time to and from the sea floor using the scalar constant designed from multiple wells in the 3-D survey area; and (3) adding back the two-way time of water bottom reflection at the control well to the velocity function, completing a first stage of spatial adjustment of the velocity volume to compensate for varying water depth;

b. using the slope and the intercept of the normal compaction trend velocity function found in the process of designing the normal compaction trend velocity function, constructing a normal compaction trend velocity function as a function of time;

c. from the function constructed in step b, above, and the observed velocities at each spatial location, finding a quotient function;

d. converting the quotient function into a pore pressure gradient function for each of the spatial locations in the 3-D survey area using an empirical, nonlinear polynomial relationship, and reversing the temporal shifts introduced earlier, resulting in a prediction of 3-D pore pressure; and e. converting the prediction, in step d above, to mud weight equivalent values.

* * * * *